US006976535B2

(12) United States Patent
Aronstam et al.

(10) Patent No.: US 6,976,535 B2
(45) **Date of Patent: *Dec. 20, 2005**

(54) METHOD OF UTILIZING FLOWABLE DEVICES IN WELLBORES

(75) Inventors: Peter Aronstam, Houston, TX (US); Per-Erik Berger, Vestre Amoy (NO)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/753,117

(22) Filed: Jan. 7, 2004

(65) Prior Publication Data

US 2005/0011645 A1 Jan. 20, 2005

Related U.S. Application Data

(63) Continuation of application No. 10/207,554, filed on Jul. 29, 2002, now Pat. No. 6,745,833, which is a continuation of application No. 09/578,623, filed on May 25, 2000, now Pat. No. 6,443,228.

(60) Provisional application No. 60/136,656, filed on May 28, 1999, provisional application No. 60/147,427, filed on Aug. 5, 1999.

(51) Int. Cl.[7] ..... E21B 47/00

(52) U.S. Cl. ..... 166/250.11; 166/255.1; 175/40; 73/152.28; 73/152.55

(58) Field of Search ..... 166/66, 72, 250.01, 166/250.11, 255.1, 381; 175/40, 44, 45, 46, 175/48, 50; 73/152.55, 152.28, 156.02

(56) References Cited

U.S. PATENT DOCUMENTS

| | | | | |
|---|---|---|---|---|
| 2,943,814 | A | 7/1960 | Mittag et al. | 243/16 |
| 3,260,112 | A | 7/1966 | Godbey et al. | 73/356 |
| 3,961,493 | A | 6/1976 | Nolan, Jr. et al. | 61/72.3 |
| 4,120,313 | A | 10/1978 | Lewis | 137/268 |
| 4,660,638 | A | 4/1987 | Yates, Jr. | 166/250 |
| 4,691,572 | A | 9/1987 | van den Berg et al. | 73/643 |
| 4,799,546 | A | 1/1989 | Hensley et al. | 166/250 |
| 4,799,552 | A | 1/1989 | Acree | 166/305.1 |
| 4,916,312 | A | 4/1990 | Ellis et al. | 250/260 |
| 5,130,705 | A | 7/1992 | Allen et al. | 340/853.9 |
| 5,461,313 | A | 10/1995 | Bohon et al. | 324/240 |
| 5,675,251 | A | 10/1997 | MacLean et al. | 324/220 |
| 5,678,630 | A | 10/1997 | Shaw et al. | 166/241.4 |
| 5,947,213 | A | 9/1999 | Angle et al. | 175/24 |
| 5,956,135 | A | 9/1999 | Quesnel | 356/241 |
| 6,026,911 | A | 2/2000 | Angle et al. | 175/24 |
| 6,196,075 | B1 | 3/2001 | Comello et al. | 73/865.8 |
| 6,234,257 | B1 | 5/2001 | Ciglenec et al. | 175/50 |
| 6,241,028 | B1 | 6/2001 | Bijleveld et al. | 175/40 |
| 6,243,657 | B1 | 6/2001 | Tuck et al. | 702/150 |
| 6,244,375 | B1 * | 6/2001 | Norris et al. | 181/102 |
| 6,324,904 | B1 | 12/2001 | Ishikawa et al. | 73/152.03 |
| 6,443,228 | B1 * | 9/2002 | Aronstam et al. | 166/250.11 |
| 6,554,064 | B1 * | 4/2003 | Restarick et al. | 166/250.01 |
| 6,745,833 | B2 * | 6/2004 | Aronstam et al. | 166/250.11 |

* cited by examiner

*Primary Examiner*—Jennifer H Gay
(74) *Attorney, Agent, or Firm*—Madan, Mossman & Sriram, P.C.

(57) ABSTRACT

Flowable devices provide communicate between surface and downhole instruments. The flowable devices having unique addresses are introduced into the flow of a fluid flowing in the wellbore. The flowable devices are used for providing information to a downhole controller and/or retrieving information from a downhole device.

11 Claims, 6 Drawing Sheets

METHOD OF UTILIZING FLOWABLE DEVICES IN WELLBORES

CROSS-REFERENCE TO RELATED APPLICATIONS

This application is a Continuation of U.S. patent application Ser. No. 10/207,554 filed Jul. 29, 2002, now U.S. Pat. No. 6,745,833, which is a Continuation of U.S. patent application Ser. No. 09/578,623 filed May 25, 2000, now U.S. Pat. No. 6,443,228, claiming priority from U.S. Patent Application Ser. No. 60/136,656 filed May 28, 1999 and 60/147,427 filed Aug. 5, 1999, each assigned to the assignee of this application.

BACKGROUND OF THE INVENTION

1. Field of the Invention

This invention relates generally to oilfield wellbores and more particularly to wellbore systems and methods for the use of flowable devices in such wellbores.

2. Background of the Art

Hydrocarbons, such as oil and gas, are trapped in subsurface formations. Hydrocarbon-bearing formations are usually referred to as the producing zones or oil and gas reservoirs or "reservoirs." To obtain hydrocarbons from such formations, wellbores or boreholes are drilled from a surface location or "well site" on land or offshore into one or more such reservoirs. A wellbore is usually formed by drilling a borehole of a desired diameter or size by a drill bit conveyed from a rig at the well site. The drill string includes a hollow tubing attached to a drilling assembly at its bottom end. The drilling assembly (also referred to herein as the "bottomhole assembly" or "BHA") includes the drill bit for drilling the wellbore and a number of sensors for determining a variety of subsurface or downhole parameters. The tubing usually is a continuous pipe made by joining relatively small sections (each section being 30–40 feet long) of rigid metallic pipe (commonly referred to as the "drill pipe") or a relatively flexible but continuous tubing on a reel (commonly referred to as the "coiled-tubing"). When coiled tubing is used, the drill bit is rotated by a drilling motor in the drilling assembly. Mud motors are most commonly utilized as drilling motors. When a drill pipe is used as the tubing, the drill bit is rotated by rotating the drill pipe at the surface and/or by the mud motor. During drilling of a wellbore, drilling fluid (commonly referred to as the "mud") is supplied under pressure from a source thereof at the surface through the drilling tubing. The mud passes through the drilling assembly, rotates the drilling motor, if used, and discharges at the drill bit bottom. The mud discharged at the drill bit bottom returns to the surface via the spacing between the drill string and the wellbore (also referred herein as the "annulus") carrying the rock pieces (referred to in the art as the "cuttings") therewith.

Most of the currently utilized drilling assemblies include a variety of devices and sensors to monitor and control the drilling process and to obtain valuable information about the rock, wellbore conditions, and the matrix surrounding the drilling assembly. The devices and sensors used in a particular drilling assembly depend upon the specific requirements of the well being drilled. Such devices include mud motors, adjustable stabilizers to provide lateral stability to the drilling assembly, adjustable bends, adjustable force application devices to maintain and to alter the drilling direction, and thrusters to apply desired amount of force on the drill bit. The drilling assembly may include sensors for determining (a) drilling parameters, such as the fluid flow rate, rotational speed (r.p.m.) of the drill bit and/or mud motor, the weight on bit ("WOB"), and torque of the bit; (b) borehole parameters, such as temperature, pressure, hole size and shape, and chemical and physical properties of the circulating fluid, inclination, azimuth, etc., (c) drilling assembly parameters, such as differential pressure across the mud motor or BHA, vibration, bending, stick-slip, whirl; and (d) formation parameters, such as formation resistivity, dielectric constant, porosity, density, permeability, acoustic velocity, natural gamma ray, formation pressure, fluid mobility, fluid composition, and composition of the rock matrix.

During drilling, there is ongoing need to adjust the various devices in the drill string. Frequently, signals and data are transmitted from surface control units to the drilling assembly. Data and the sensor results from the drilling assembly are communicated to the surface. Commonly utilized telemetry systems, such as mud pulse telemetry and acoustic telemetry systems, are relatively low data rate transfer systems. Consequently, large amounts of downhole measured and computed information about the various above-noted parameters is stored in memory in the drilling assembly for later use. Also, relatively few instructions and data can be transmitted from the surface to the drilling assembly during the drilling operations.

After the well has been drilled, the well may be completed, i.e., made ready for production. The completion of the wellbore requires a variety of operations, such as setting a casing, cementing, setting packers, operating flow control devices, and perforating. There is need to send signals and data from the surface during such completion operations and to receive information about certain downhole parameters. This information may be required to monitor status and/or for the operation of devices in the wellbore ("downhole devices"), to actuate devices to perform a task or operation or to gather data about the subsurface wellbore completion system, information about produced or injected fluids or information about surrounding formation. After the well has started to produce, there is a continuous need to take measurements of various downhole parameters and to transmit downhole generated signals and data to the surface and to receive downhole information transmitted from the surface.

The present invention provides systems and methods wherein discrete flowable devices are utilized to communicate surface-generated information (signals and data) to downhole devices, measure and record downhole parameters of interest, and retrieve from downhole devices, and to make measurements relating to one or more parameters of interest relating to the wellbore systems.

SUMMARY OF THE INVENTION

This invention provides a method of utilizing flowable devices to communicate between surface and downhole instruments and to measure downhole parameters of interest. In one method, one or more flowable devices are introduced into fluid flowing in the wellbore. The flowable device is a data carrier, which may be a memory device, a measurement device that can make one or more measurements of a parameter of interest, such as temperature, pressure and flow rate, and a device with a chemical or biological base that provides some useful information about a downhole parameter or a device that can transfer power to another device.

In one aspect of the invention, memory-type flowable devices are sent downhole wherein a device in the wellbore reads stored information from the flowable devices and/or writes information on the flowable device. If the flowable device is a measurement device, it takes the measurement, such as temperature, pressure, flow rate, etc., at one or more locations in the wellbore. The flowable devices flow back to the surface with the fluid, where they are retrieved. The data in the flowable devices and/or the measurement information obtained by the flowable devices is retrieved for use and analysis.

During drilling of a wellbore, the flowable devices may be introduced into the drilling fluid pumped into the drill string. A data exchange device in the drill string reads information from the flowable devices and/or writes information on the flowable devices. An inductive coupling device may be utilized for reading information from or writing information on the flowable devices. A downhole controller controls the information flow between the flowable device and other downhole devices and sensors. The flowable devices return to the surface with the circulating drilling fluid and are retrieved. Each flowable device may be assigned an address for identification. Redundant devices may be utilized.

In a production well, the flowable devices may be pumped downhole via a tubing that runs from a surface location to a desired depth in the wellbore and then returns to the surface. A U-shaped tubing may be utilized for this purpose. The flowable devices may also be carried downhole via a single tubing or stored in a container or magazine located or placed at a suitable location-downhole, from which location the flowable devices are released into the flow of the produced fluid, which carries the flowable devices to the surface. The release or disposal from the magazine may be done periodically, upon command, or upon the occurrence of one or more events. The magazine may be recharged by intervention into the wellbore. The tubing that carries the flowable devices may be specifically made to convey the flowable devices or it may be a hydraulic line with additional functionality. The flowable devices may retrieve information from downhole devices and/or make measurements along the wellbore. A plurality of flowable devices may be present in a wellbore at any given time, some of which may be designed to communicate with other flowable device or other downhole device, thereby providing a communication network in the wellbore. The flowable devices may be intentionally implanted in the wellbore wall to form a communication link or network in the wellbore. A device in the wellbore reads the information carried by the flowable devices and provides such information to a downhole controller for use. The information sent downhole may contain commands for the downhole controller to perform a particular operation, such as operating a device. The downhole controller may also send information back to the surface by writing information on the flowable devices. This may be information from a downhole system or confirmation of the receipt of the information from surface.

Examples of the more important features of the invention have been summarized rather broadly in order that the detailed description thereof that follows may be better understood, and in order that the contributions to the art maybe appreciated. There are, of course, additional features of the invention that will be described hereinafter and which will form the subject of the claims appended hereto.

BRIEF DESCRIPTION OF THE DRAWINGS

For a detailed understanding of the present invention, reference should be made to the following detailed description of the preferred embodiment, taken in conjunction with the accompanying drawings, in which like elements have been given like numerals, wherein.

DETAILED DESCRIPTION OF THE PREFERRED EMBODIMENT

The present invention utilizes "flowable devices" in wellbores to perform one or more functions downhole. For the purpose of this disclosure, a flowable device means a discrete device which is adapted to be moved at least in part, by a fluid flowing in the wellbore. The flowable device according to this invention is preferably of relatively small size (generally in the few millimeters to a centimeter range in outer dimensions) that can perform a useful function in the wellbore. Such a device may make measurements downhole, sense a downhole parameter, exchange data with a downhole device, store information therein, and/or store power. The flowable device may communicate data and signals with other flowable devices and/or devices placed in the wellbore ("downhole devices"). The flowable device may be programmed or coded with desired information. An important feature of the flowable devices of the present invention is that they are sufficiently small in size so that they can circulate with the drilling fluid without impairing the drilling operations. Such devices preferably can flow with a variety of fluids in the wellbore. In another aspect of the invention, the devices may be installed in the wellbore wall either permanently or temporarily to form a network of devices for providing selected measurement of one or more downhole parameters. The various aspects of the present invention are described below in reference to FIGS. 1–6 utilizing exemplary wellbores.

In a preferred embodiment, the flowable device may include a sensor for providing measurements relating to one or more parameters of interest, a memory for storing data and/or instructions, an antenna for transmitting and/or receiving signals from other devices and/or flowable devices in the wellbore and a control circuit or controller for processing, at least in part, sensor measurements and for controlling the transmission of data from the device, and for processing data received from the device. The device may include a battery for supplying power to its various components. The device may also include a power generation device due to the turbulence in the wellbore fluid flow. The generated power may be utilized to charge the battery in the device.

Figure 1:
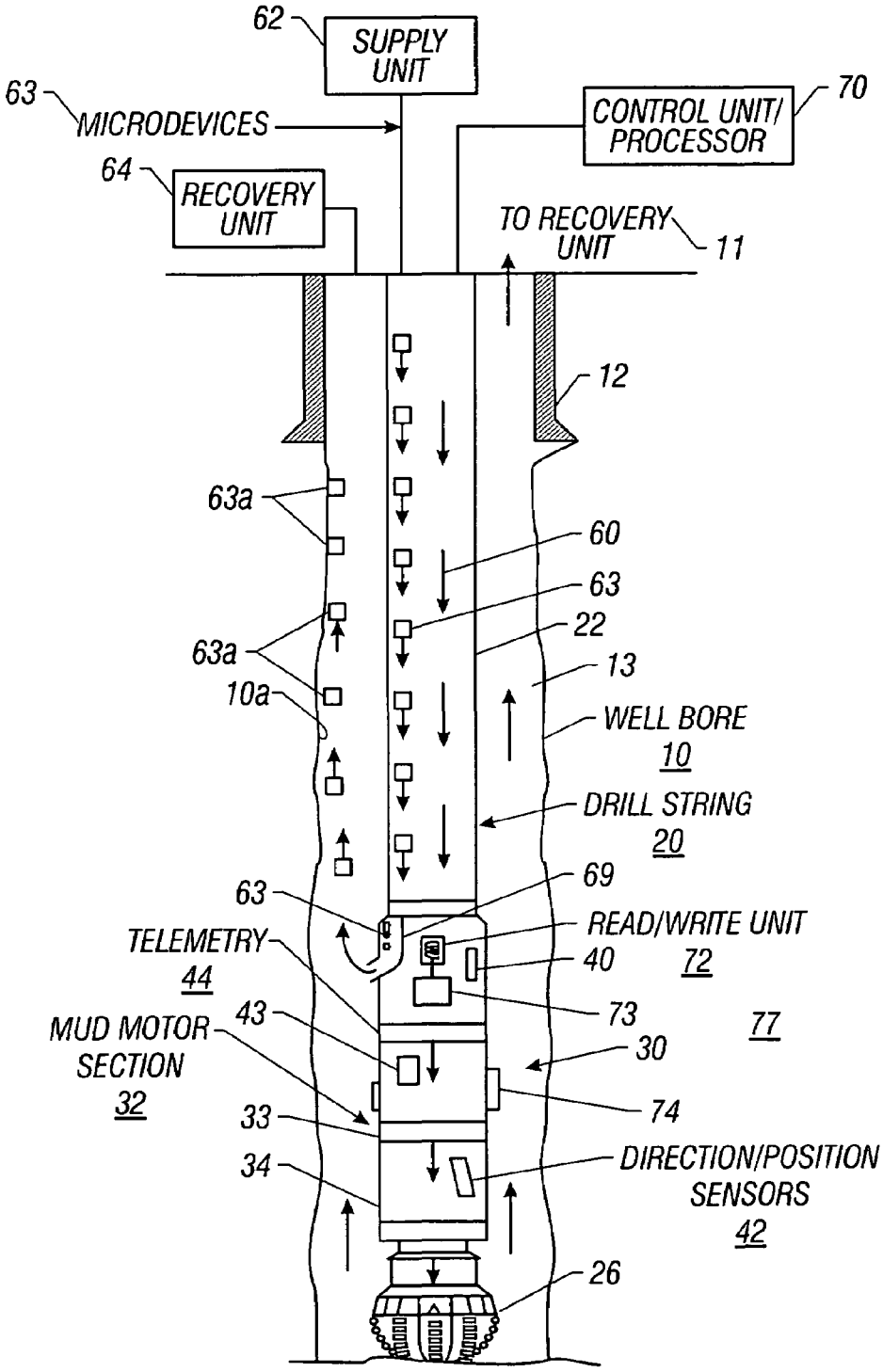
FIG. 1 is a schematic illustration of a drill string in a wellbore during drilling of a wellbore, wherein flowable devices are pumped downhole with the drilling fluid.

FIG. 1 is an illustration of the use of flowable devices during drilling of a wellbore, which shows a wellbore 10 being drilled by a drill string 20 from a surface location 11. A casing 12 is placed at an upper section of the wellbore 10 to prevent collapsing of the wellbore 10 near the surface 11. The drilling string 20 includes a tubing 22, which may be a drill pipe made from joining smaller sections of rigid pipe or a coiled tubing, and a drilling assembly 30 (also referred to as a bottom hole assembly or "BHA") attached to the bottom end 24 of the tubing 22.

The drilling assembly 30 carries a drill bit 26, which is rotated to disintegrate the rock formation. Any suitable drilling assembly may be utilized for the purpose of this invention. Commonly used drilling assemblies include a variety of devices and sensors. The drilling assembly 30 is shown to include a mud motor section 32 that includes a power section 33 and a bearing assembly section 34. To drill the wellbore 10, drilling fluid 60 from a source 62 is supplied under pressure to the tubing 22. The drilling fluid 60 causes the mud motor 32 to rotate, which rotates the drill bit 26. The bearing assembly section 34 includes bearings to provide lateral and axial stability to a drill shaft (not shown) that couples the power section 33 of the mud motor 32 to the drill bit 26. The drilling assembly 30 contains a plurality of direction and position sensor 42 for determining the position (x, y and z coordinates) with respect to a known point and inclination of the drilling assembly 30 during drilling of the wellbore 10. The sensors 42 may include, accelerometers, inclinometers, magnetometers, and navigational devices. The drilling assembly further includes a variety of sensors denoted herein by numeral 43 for providing information about the borehole parameters, drilling parameters and drilling assembly condition parameters, such as pressure, temperature, fluid flow rate, differential pressure across the mud motor, equivalent circulatory density of the drilling fluid, drill bit and/or mud motor rotational speed, vibration, weight on bit, etc. Formation evaluation sensors 40 (also referred to as the "FE" sensors) are included in the drilling assembly 30 to determine properties of the formations 77 surrounding the wellbore 10. The FE sensors typically include resistivity, acoustic, nuclear and nuclear magnetic resonance sensors which alone provided measurements that are used alone or in combination of measurements from other sensors to calculate, among other things, formation resistivity, water saturation, dielectric constant, porosity, permeability, pressure, density, and other properties or characteristics of the formation 77. A two-way telemetry unit 44 communicates data/signals between the drilling assembly 30 and a surface control unit or processor 70, which usually includes a computer and associated equipment.

During drilling, according to one aspect of the present invention, flowable devices 63 are introduced from a suppy unit 62 at one or more suitable locations into the flow of the drilling fluid 60. The flowable devices 63 travel with the fluid 60 down to the BHA 30 (forward flow), wherein they are channeled into a passage 69. A data exchange device 72, usually a read/write device disposed adjacent to or in the passage 69, which can read information stored in the devices 63 (at the surface or obtained during flow) and can write on the devices 63 any information that needs to be sent back to the surface 11. An inductive coupling unit or another suitable device may be used as a read/write device 72. Each flowable device 63 may be programmed at the surface with a unique address (identification) and specific or predetermined information. Such information may include instructions for the controller 73 or other electronic circuits to perform a selected function, such as activate ribs 74 of a force application unit to change drilling direction or the information may include signals for the controller 73 to transmit values of certain downhole measured parameters or take another action. The controller 73 may include a microprocessor-based circuit that causes the read/write unit 72 to exchange appropriate information with the flowable devices 63. The controller 73 process downhole the information received from the flowable devices 63 and also provides information to the devices 63 that is to be carried to the surface. The read/write device 72 may write data that has been gathered downhole on the flowable devices 63 leaving the passage 69. The devices 63 may also be measurement or sensing devices, in that, they may provide measurements of certain parameters of interest such as pressure, temperature, flow rate, viscosity, composition of the fluid, presence of a particular chemical, water saturation, composition, corrosion, vibration, etc. The devices 63 return to the surface 11 with the fluid circulating through the annulus 13 between the welibore 10 and drill string 22.

The flowable devices returning to the surface designated herein for convenience by numeral 63*a* are received at the surface by a recovery unit 64. The returning devices 63*a* may be recovered by filtering magnetic force or other techniques. The information contained in the returning devices 63*a* is retrieved, interpreted and used as appropriate. Thus, in the drilling mode, the flowable devices 63 flow downhole where they perform an intended function, which may be taking measurements of a parameter of interest or providing information to a downhole controller 73 or retrieving information from a downhole device. The devices 63*a* return to the surface (the return destination) via the annulus 13.

During drilling, some of the devices may be lost in the flow process or get attached or stuck to the wall of the wellbore 10. Redundant devices may be supplied to account for such loss. Once the controller 73 has communicated with a device having a particular address, it may be programmed to ignore the redundant device. Alternatively, the controller 73 may cause a signal to be sent to the surface confirming receipt of each address. If a particular address is not received by the downhole device 72, a duplicate device may be sent. The devices 63*a* that get attached to the wellbore wall 10*a* (see FIG. 2), may act as sensors or communication locations in the wellbore 10. A stuck device may communicate with another flowable device stuck along the wall 10*a* or with devices passing adjacent the stuck device, thereby forming a communications network. The returning devices 63*a* can retrieve information from the devices stuck in the well 10. Thus, the flowable devices in one aspect, may form a virtual network of devices which can pass data/information to the surface. Alternatively, some of the devices 63 may be adapted or designed to lodge against or deposited on the wellbore wall 10*a*, thereby providing permanent sensors and/or communication devices in the wellbore 10. In one embodiment, the flowable devices may be designed to be deposited on the borehole wall during the drilling process. As one flowable device can communicate with another neighboring flowable device, a plurality of flowable devices deposited on the wellbore wall may form a communications network. As drilling of new formation continues new flowable devices are constantly deposited on the borehole wall to maintain the network. When drilling of the section is completed, the flowable devices may be retrieved from the borehole wall for use in another application. The devices 63 may include a movable element that can generate power due to turbulence in the wellbore fluid, which power can be used to change a resident battery in the flowable devices. Further, the devices 63 may include a propulsion mechanism (as more fully explained in reference to FIG. 6) that aids these devices in flowing with or in the fluid 60. The devices 63 usually are autonomous devices and may include a dynamic ballast that can aid such devices to flow in the fluid 60.

Figure 2:
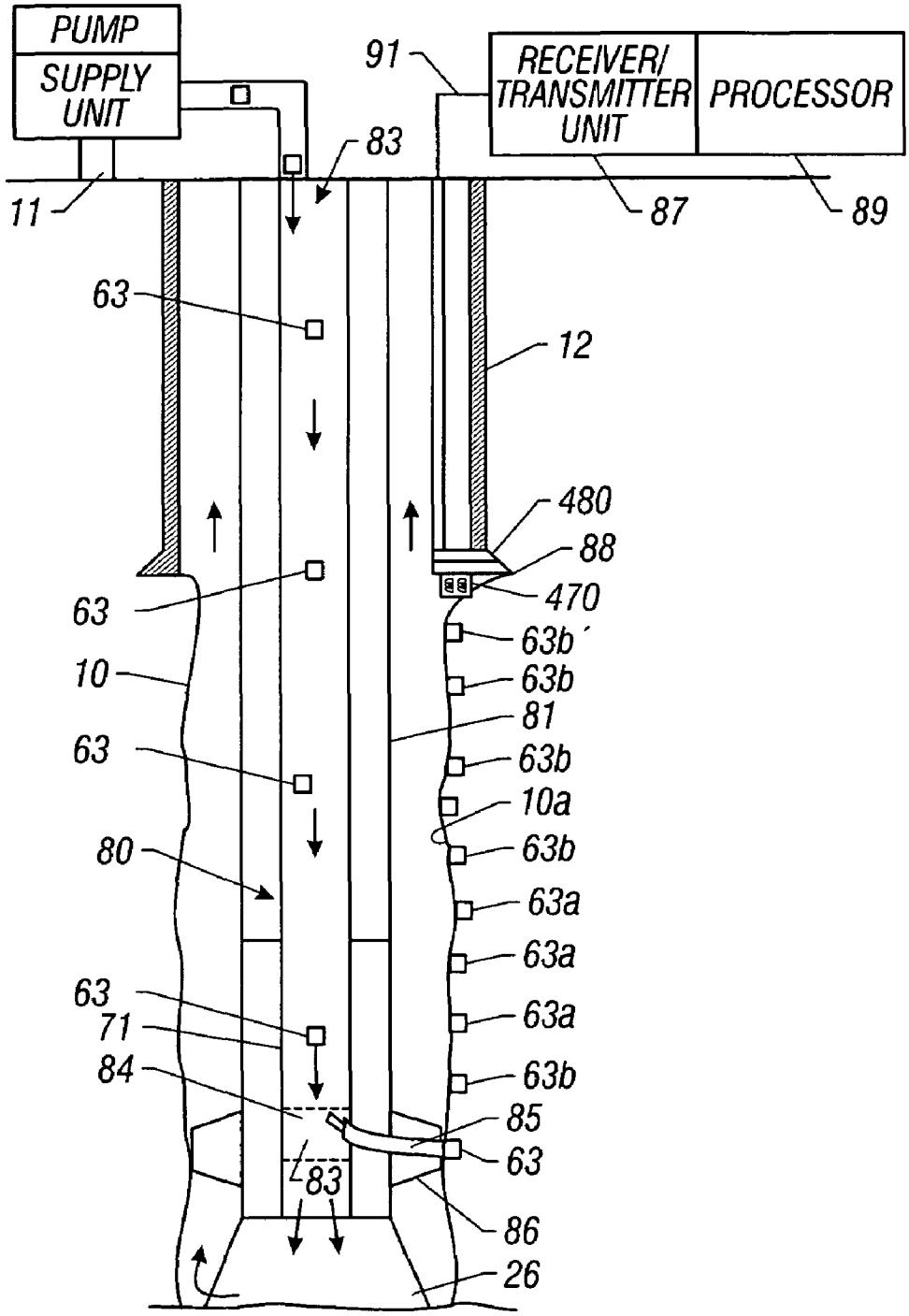
FIG. 2 is a schematic illustration of a wellbore during drilling wherein flowable devices are implanted in the borehole wall to form a communications line in the open hole section and wherein a cable is used for communication in the cased hole section.

Flowable devices may also be periodically planted in the wellbore wall in a controlled operation to form a communication line along the wellbore, as opposed to randomly depositing flowable devices using the hydraulic pressure of the drilling fluid. An apparatus may be constructed as part of the downhole assembly to mechanically apply a force to press or screw the flowable device into the wellbore wall. In this operation, the force required to implant the device may be measured, either by sensors within the flowable device itself or sensors within the implanting apparatus. This measured parameter may be communicated to the surface and used to investigate and monitor rock mechanical properties. The flowable devices may be pumped downhole to the planting apparatus, or kept in a magazine downhole to be used by the planting apparatus. In this case the flowable devices may be permanently installed. FIG. 2 which is a schematic illustration of a wellbore, wherein devices made in accordance with the present invention are implanted in the borehole wall during drilling of the wellbore 10 to form a communication network. FIG. 2 shows a well 10 being drilled by drill bit 26 at the bottom of a drilling assembly 80 carried by a drilling tubing 81. Drilling fluid 83 supplied under pressure through the tubing 81 discharges at the bottom of the drill bit 26. Flowable devices 63 are introduced or pumped into the fluid 83 and captured or retrieved by a device 84 in the drilling assembly 80. The drilling assembly 80 includes an implanting device 85 that implants the retrieved flowable devices 63 via a head 86 into the borehole wall 10*a*. The devices which are implanted during the drilling of the wellbore 10 are denoted by numeral 63*b*. The devices 63 may be pumped downhole through a dedicated tubing 71 placed in the drilling tubing 81. If coiled tubing is used as the tubing 81, the tubing 71 for carrying the flowable devices 63 to the implanter 85 may be built inside or outside the coiled tubing.

Alternatively, the devices to be implanted may be stored in a chamber or magazine 83, which deliver them to the implanter 85. The implanted flowable devices 63*b* in the well 10 can exchange data with each other and/or other flowable devices returning to the surface via the annulus 13 and/or with other devices in the drill string as described above in reference to FIG. 1. A communication device 88 may be disposed in the well at any suitable location, such as below the upper casing 12 to communicate with the implanted devices 63*b*. The communication device 88 may communicate with one or more nearby flowable devices 63*b* such as a device denoted by numeral 63*b*', which device then communicates with next device and so forth down the line to the remaining implanted devices 63*b*. Similarly, the implanted devices 63*b* communicate uphole up to the devices 63*b*' which communicates with the device 88, thus establishing a two-way communication link or line along the wellbore 10. The device 88 can read data from and write data on the devices 63*b*. It is operatively coupled to a receiver/transmitter unit 87 and a processor 89 at the surface by a conductor or link 91. The link 91 may be an electrical conduct or a fiber optic link. The processor 89 processes the data received by the receiver/transmitter unit 87 from the devices 63*b* and also sends data to the devices 63*b* via the receiver/transmitter 87. The implanted devices 63*b* may be used to take measurements for one or more selected downhole parameters during and after the drilling of the wellbore 10.

Figure 3:
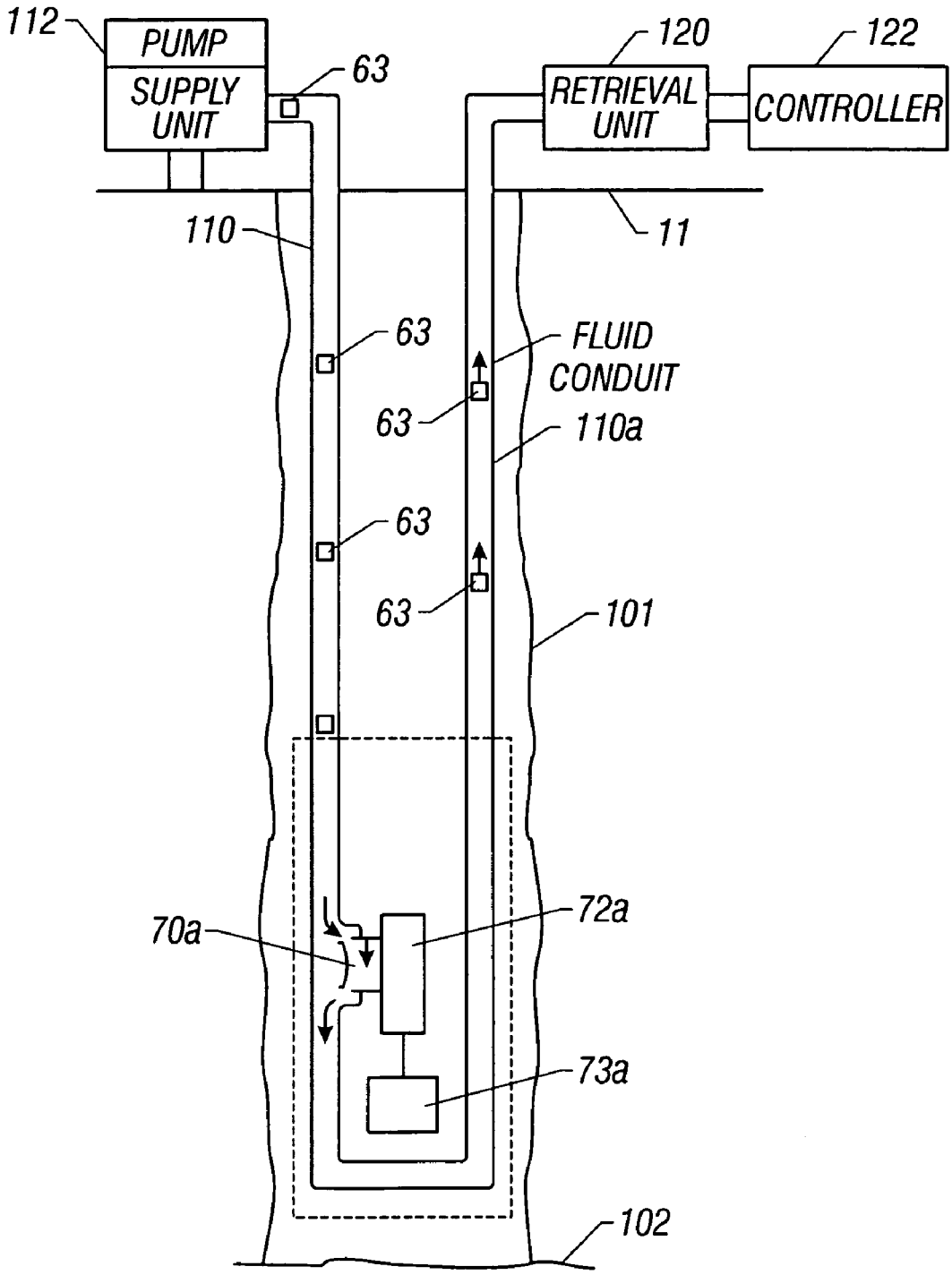
FIG. 3 is a schematic illustration of a wellbore wherein flowable devices are pumped downhole and retrieved to the surface via a U-shaped hydraulic or fluid line disposed in the wellbore.

FIG. 3 illustrates an alternative method of transporting the devices 63 to a downhole location. FIG. 3 shows a wellbore 101 formed to a depth 102. For simplicity and ease of understanding, normal equipment and sensors placed in a wellbore are not shown. A fluid conduit 110 is disposed in the wellbore. The conduit 110 runs from a fluid supply unit 112, forms a U-return 111 and returns to the surface 11. Flowable devices 63 are pumped into the conduit 110 by the supply unit 112 with a suitable fluid. A downhole device 72*a* retrieves information from the flowable devices 63 passing through a channel 70*a* and/or writes information on such devices. A controller 73*a* receives the information from the flowable devices 63 and utilizes it for the intended purpose. Controller 73*a* also controls the operation of the device 72*a* and thus can cause it to transfer the required information onto the flowable devices 63. The flowable devices 63 then return to the surface via the return segment 110*a* of the tubing 110. A retrieval unit 120 at the surface recovers the returning flowable devices 63*a*, which may be analyzed by a controller 122 or by another method. The devices 63 may perform sensory and other functions described above in references to FIG. 1.

Figure 4:
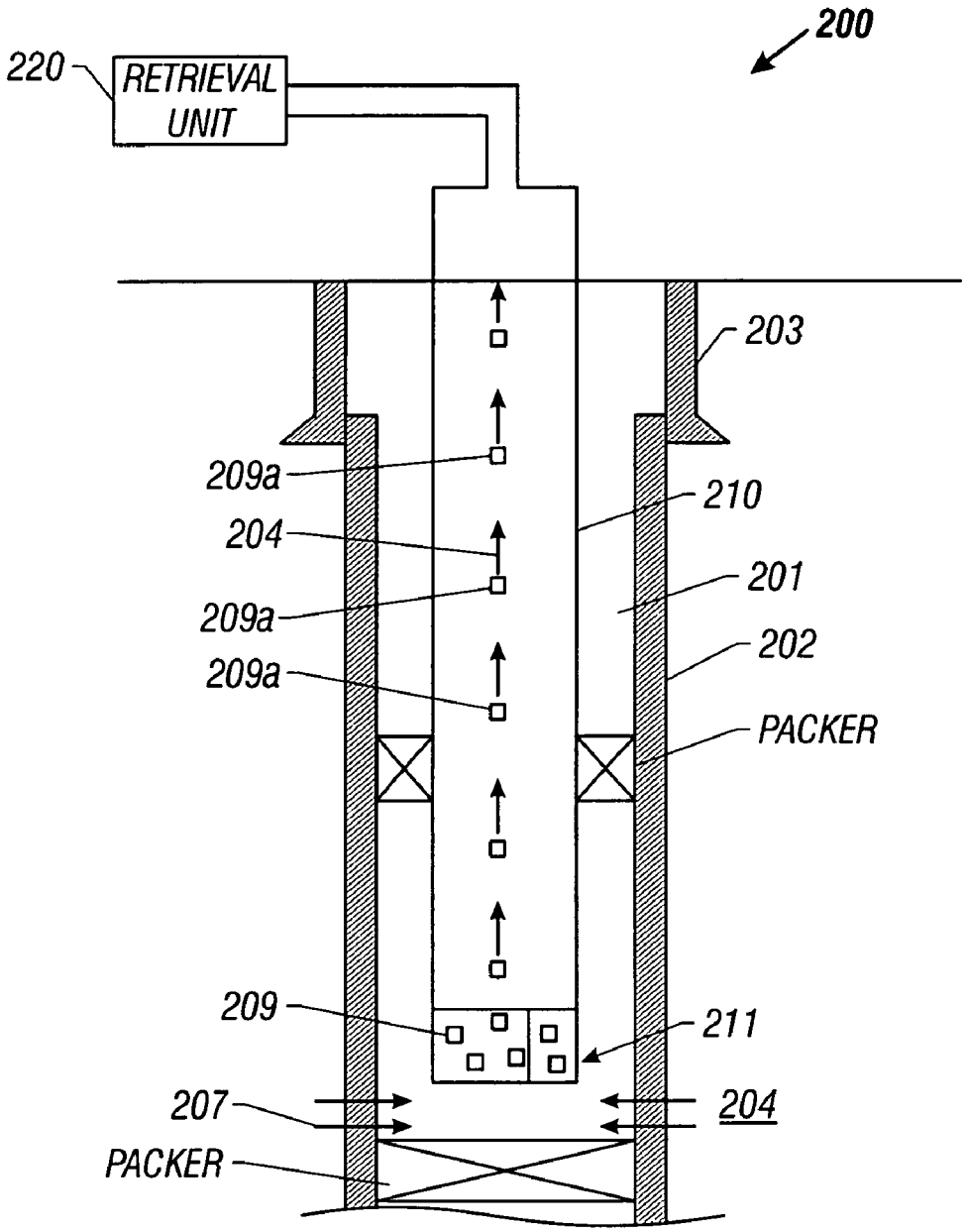
FIG. 4 is a schematic illustration of a production well wherein flowable devices are released in the flow of the produced fluid at a suitable location.

FIG. 4 is a schematic illustration of a production well 200 wherein flowable devices 209 are released into the produced fluid or formation fluid 204, which carries these devices to the surface. FIG. 4 shows a well 201 that has an upper casing 203 and a well casing 202 installed therein. Formation fluid 204 flows into the well 201 through perforations 207. The fluid 204 enters the wellbore and flows to the surface via a production tubing 210. For simplicity and ease of understanding, FIG. 4 does not show the various production devices, such as flow control screens, valves and submersible pumps, etc. A plurality of flowable devices 209 are stored or disposed in a suitable container at a selected location 211 in the wellbore 201. The devices 209 are selectively released into the flow of the produced fluid 204, which fluid carries these devices, the released devices are designated by numeral 209*a* to the surface. The devices 209*a* are retrieved by a retrieval unit 220 and analyzed. As noted above in reference to FIGS. 1 and 3, the flowable devices 209*a* may be sensor devices or information containing devices or both. Periodic release of sensory devices can provide information about the downhole conditions. Thus, in this aspect of the invention, the flowable devices are released in the well 201 to transfer downhole information during the production phase of the well 201.

Communication in open-hole sections may be achieved using flowable devices in the drilling mud deposited on the borehole wall, or by using implanted flowable devices as described above. In cased hole sections often found above open-hole sections, communications may be achieved in several ways; through flowable devices deposited in the mud filter cake or implanted in the borehole wall during the drilling process, or through flowable devices mixed in the cement which fills the annulus between the borehole wall/mud filter cake and the casing, or through a communication channel installed as part of the casing. The latter may include a receiver at the bottom of the casing to pick up information from the devices, and a transmitter to send this information to the surface and vice versa. The communication device associated with the casing could be an electrical or fibre-optic or other type of cable, an acoustic signal or an electromagnetic signal carried within the casing or within the earth, or other methods of communication. In conclusion, a communication system based on the use of flowable devices may be used in combination with other communication methods to cover different sections of the wellbore, or to communicate over distances not covered by a wellbore.

Another example of using flowable devices in combination with other communication systems is a multilateral well. One or more laterals of the well may have a two-way communication system with flowable devices, while one or more laterals of the same well may not have a full two-way communication system with the flowable devices. In one embodiment of the invention, the first lateral is equipped with a single tube or a U-tube that allows flowable devices containing information from surface to travel to the bottom of the first lateral. The second lateral is not equipped with a tubing, but has flowable devices stored in a downhole magazine. A message to the second lateral is pumped into the first lateral. From the receiver station in the first lateral, information such as a command to release a flowable device in the second lateral, is transmitted from the first lateral to the second lateral through acoustic or electromagnetic signals through the earth. Upon receipt of this information in the second lateral, the required task, such as writing to and releasing a flowable device or initiating some action downhole is performed. Provided the distance and formation characteristics allow transmission of signal through the earth formation, the same concept can be used to communicate between individual wellbores.

Figure 5:
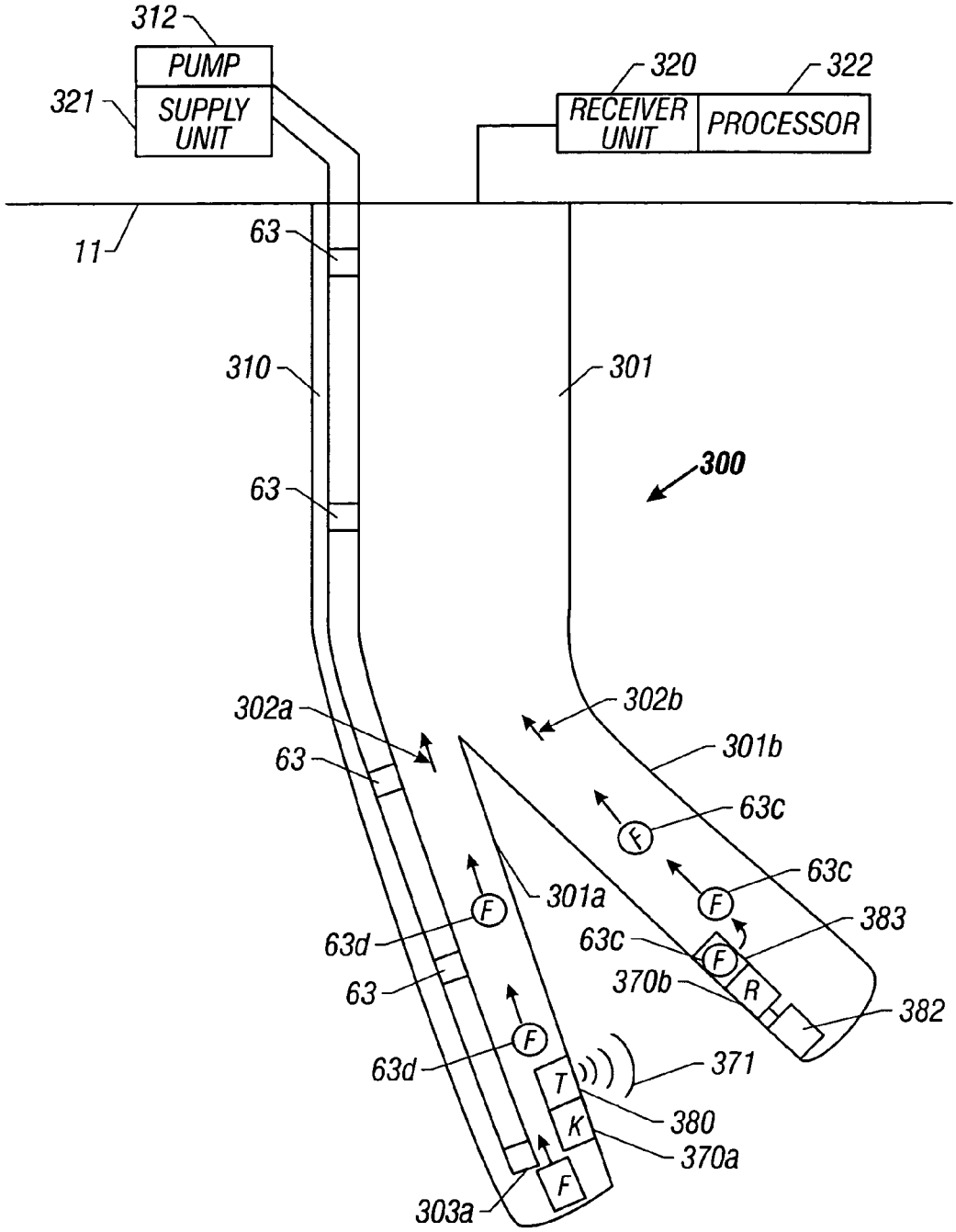
FIG. 5 is a schematic illustration of a multi-lateral production wellbore wherein flowable devices are pumped down through a hydraulic line and released into the fluid flow of the first lateral and where information is communicated from the first lateral to the second lateral through the earth formation and wherein flowable devices may also be released into the fluid flow of the second lateral to carry such devices to the surface.

FIG. 5 is an exemplary schematic illustration of an multilateral production well 300, wherein flowable devices are pumped into one branch or lateral and then utilized for communication between the laterals. FIG. 5 shows a main well section 301 having two branch wells or laterals 301*a* and 301*b*. In the exemplary lateral wellbore configuration of FIG. 5, both wells 301*a* and 301*b* are shown to be production wells. Well 301*a* and 301*b* produce fluids (hydrocarbons) which are shown by arrow 302*a* and 302*b*, respectively. Flowable devices 63 are pumped into the first lateral 301*a* via a tubing 310 from a supply unit 321 at the surface 11. The devices 63 are discharged at a known depth 303*a* where a receiver unit 370*a* retrieves data from the devices 63. The devices return to the surface with the produced fluid 302*a*. The returning devices from wellbore 301 are denoted by 63*d*. A transmitter unit 380 transmits signals 371 in response to information retrieved from the flowable devices 63. A second receiver 370*b* in the second lateral 301*b* receives signals 371. A controller unit or processor 382 utilizes the received signals to perform an intended function or operation, which may include operating a device downhole, such as a valve, a sliding sleeve, or a pump, etc. Flowable devices 63*c* may be disposed in magazine 383 in the second lateral 301*b* and released into the fluid flow 302*b* by the controller 382. The devices 63*d* and 63*c* flowing uphole are retrieved at the surface by a receiver unit 320 and the data carried by the flowable devices 63*c* and 63*d* is processed by the processor 322. It should be noted that FIG. 5 is only one example of utilizing the flowable devices in multiple wellbores. The wells selected for intercommunication may be separate wells in a field. The signals 371 may be received by instruments in one or more wells and/or at the surface for use in performing an intended task.

Figure 6:
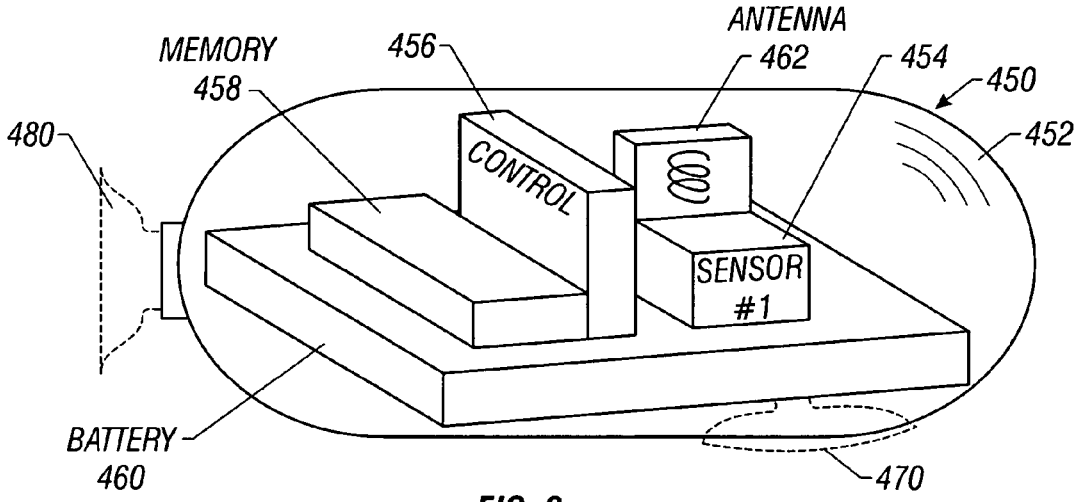
FIG. 6 is a block functional diagram of a flowable device according to one embodiment of the present invention.

FIG. 6 shows a block functional diagram of a flowable device 450 according to one embodiment of the present invention. The device 450 is preferably encapsulated in a material 452 that is suitable for downhole environment such as ceramic, and includes one or more sensor elements 454, a control circuit or controller 456 and a memory unit 458. A resident power supply 460 supplies power to the sensor 454, controller 456, memory 458 and any other electrical component of the device 450. The controller 456 may include a processor that interacts with one or more programs in the device to process the data gathered by the device and/or the measurements made by the device to compute, at least partly, one or more parameters of interest, including results or answers. For example, the device 450 may calculate a parameter, change its future function and/or transmit a signal in response to the calculated parameter to cause an action by another flowable device or a device in the wellbore. For example, the device may determine a detrimental condition downhole, such as presence of water and then send a signal to a fluid flow control device in the wellbore to shut down a production zone or the well. The device may be designed to have sufficient intelligence and processing capability so it can take any number of different actions in the wellbore. A power generation unit that generates electrical power due to the turbulence in the flow may be incorporated in the device 450 to charge a battery (resident power supply) 460. An antenna 462 is provided to transmit and/or receive signals, thereby providing one-way or two-way communication (as desired) between the flowable device 450 and another device, which may be a flowable device or a device located downhole or at the surface. The device 450 may be programmed at the surface or downhole to carry data and instructions. The surface information programmed into a flowable device is read by a device in the wellbore while the downhole programmed information may be read at the surface or by reading devices downhole. The device 450 may transmit and receive signals in the wellbore and thus communicate with other devices. Such a flowable device can transfer or exchange information with other devices, establish communication link along the wellbore, provide two-way communication between surface and downhole devices, or between different wellbores in a field or laterals of a wellbore system, and establish a communication network in the wellbore and/or between the surface instrumentation and downhole devices. Each such device may be coded with an identification number or address, which can be utilized to confirm the receipt or transfer of information by the devices deployed to receive the information from the flowable device 450. In one method, the flowable device 450 may be sequentially numbered and introduced into the fluid flow to be received at a target location. If the receiving device receives a flowable device, it can cause a signal to be sent to the sending location, thereby confirming the arrival of a particular device. If the receiving device does not confirm the arrival of a particular device, a second device carrying the same information and the address may be sent. This system will provide a closed loop system for transferring information between locations.

In another aspect of the invention, the flowable device may contain a chemical that alters a state in response to a downhole parameter, which provides a measure of a downhole parameter. Other devices, such as devices that contain biological mass or mechanical devices that are designed to carry information or sense a parameters may also be utilized. In yet another aspect, the flowable device may be a device carrying power, which may be received by the receiving device. Thus, specially designed flowable devices may be utilized to transfer power from one location to another, such as from the surface to a downhole device.

The flowable device 450 may include a ballast 470 that can be released or activated to alter the buoyancy of the device 450. Any other method also may be utilized to make the device with variable buoyancy. Additionally, the device 450 may also include a propulsion mechanism 480 that can be selectively activated to aid the device 450 to flow within the fluid path. The propulsion mechanism may be self-activated or activated by an event such as the location of the device 450 in the fluid or its speed.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A method for utilizing flowable devices in a wellbore, the method comprising:

(a) providing at least one flowable device into a drilling tubular in the wellbore;

(b) providing a unique address to the at least one flowable device; and (c) using a drilling fluid in the drilling tubular for flowing said at least one flowable device to a downhole location and performing a function selected from (i) providing information to a downhole controller, and, (ii) retrieving information from a downhole device.

2. The method of claim 1, wherein selecting the at least one flowable device comprises selecting the at least one flowable device from a group consisting of: (i) a device having a sensor for providing a measure of a parameter of interest; (ii) a device having a memory for storing data therein; (iii) a device carrying energy that is transmittable to another device; (iv) a solid mass carrying a chemical that alters a state when said solid mass encounters a particular property in the wellbore; (v) a device carrying a biological mass; (vi) a data recording device;

(vii) a device that is adapted to take a mechanical action, and (viii) a self-charging device due to interaction with the working fluid in the wellbore.

3. The method of claim 1, said function comprises making a measurement of a parameter of interest and wherein said selecting the at least one flowable device comprises selecting a device that provides a measurement selected from a group consisting of: (i) pressure; (ii) temperature; (iii) flow rate; (iv) vibration; (v) presence of a particular chemical in the wellbore; (vi) viscosity; (vii) water saturation; (viii) composition of a material; (ix) corrosion; (x) velocity; (xi) a physical dimension; and (xi) deposition of a particular matter in a fluid.

4. The method of claim 1, wherein selecting the at least one flowable device comprises selecting a flowable device that is adapted to carry data that is one of (i) prerecorded on the at least one flowable device; (ii) recorded on the at least one flowable device downhole; (iii) self recorded by the at least one flowable device; (iv) inferred by a change of a state associated with the at least one flowable device.

5. The method of claim 1, wherein selecting the at least one flowable device comprises selecting a device that is one of: (i) resistant to wellbore temperatures; (ii) resistant to chemicals; (iii) resistant to pressures in wellbores; (iv) vibration resistant; (v) impact resistant; (vi) resistant to electromagnetic radiation; (vii) resistant to electrical noise; and (viii) resistant to nuclear fields.

6. The method of claim 1 further comprising recovering said at least one flowable device.

7. The method of claim 1, wherein the at least one flowable device further comprises a plurality of flowable devices, each such flowable device adapted to perform at least one task.

8. The method of claim 7, further comprising providing the plurality of flowable devices in a manner that is one of: (i) timed release, (ii) time independent release, (iii) on demand release, and (iv) event initiated release.

9. The method of claim 7 further comprising providing the plurality of flowable devices at time intervals such that some of said plurality of flowable devices remain in the wellbore at any given time, thereby forming a network of devices in the wellbore.

10. The method of claim 9 wherein at least one of the plurality of devices remaining in the wellbore communicates with at least one other of the plurality of devices remaining in the wellbore.

11. The method of claim 1 further comprising implanting a plurality of spaced apart flowable devices in said wellbore during drilling of said wellbore.

* * * * *